US011195460B2

(12) United States Patent
Xue

(10) Patent No.: US 11,195,460 B2
(45) Date of Patent: Dec. 7, 2021

(54) GOA CIRCUIT

(71) Applicant: SHENZHEN CHINA STAR OPTOELECTRONICS SEMICONDUCTOR DISPLAY TECHNOLOGY CO., LTD., Shenzhen (CN)

(72) Inventor: Yan Xue, Shenzhen (CN)

( * ) Notice: Subject to any disclaimer, the term of this patent is extended or adjusted under 35 U.S.C. 154(b) by 0 days.

(21) Appl. No.: 16/980,400

(22) PCT Filed: May 7, 2020

(86) PCT No.: PCT/CN2020/088972
§ 371 (c)(1),
(2) Date: Sep. 13, 2020

(87) PCT Pub. No.: WO2021/184509
PCT Pub. Date: Sep. 23, 2021

(65) Prior Publication Data

US 2021/0327349 A1 Oct. 21, 2021

(30) Foreign Application Priority Data

Mar. 18, 2020 (CN) ..... 202010190340.0

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0408* (2013.01); *G09G 2310/066* (2013.01)

(58) Field of Classification Search
None
See application file for complete search history.

(56) References Cited

U.S. PATENT DOCUMENTS

2015/0194444 A1* 7/2015 Koo ..... G09G 3/3677 257/43
2016/0019840 A1 1/2016 Cao et al.
2017/0018245 A1 1/2017 Park et al.
2017/0169778 A1 6/2017 Mei
(Continued)

FOREIGN PATENT DOCUMENTS

CN 103730089 A 4/2014
CN 104966500 A 10/2015
(Continued)

OTHER PUBLICATIONS

Zhang Liuqi;Han Baixiang;Nie Chenglei,Xue Yan;Chaw Gary;Lin Xinnan;School of Electronic and Computer Engineering,Peking University Shenzhen Graduate School;Shenzhen China Star Optoelectronics Technology Co.,Ltd, National Engineering Laboratory for AMOLED Process Technology; Research of a Novel Gate Driver Circuit Design for Suppressing Current Ripple of AMOLED Display.

*Primary Examiner* — Matthew Yeung

(57) ABSTRACT

A gate driver on array (GOA) circuit is provided that can simultaneously output a wide pulse width signal and a narrow pulse width signal, such that thin film transistors in the GOA circuit can be operated in a saturation area, which is adaptable to an application of external compensation of large size active-matrix organic light-emitting diode display panels.

10 Claims, 2 Drawing Sheets

(56) References Cited

U.S. PATENT DOCUMENTS

| | | | | |
|---|---|---|---|---|
| 2017/0287425 | A1* | 10/2017 | Koo | G09G 3/3696 |
| 2020/0365107 | A1* | 11/2020 | Li | G09G 3/3677 |
| 2021/0166647 | A1* | 6/2021 | Zhao | G11C 19/28 |
| 2021/0166648 | A1* | 6/2021 | Xiong | G09G 3/3677 |
| 2021/0241708 | A1* | 8/2021 | Pu | G09G 3/3677 |

FOREIGN PATENT DOCUMENTS

| | | | |
|---|---|---|---|
| CN | 108962118 | A | 12/2018 |
| CN | 109961737 | A | 7/2019 |
| CN | 110379349 | A | 10/2019 |
| KR | 20170112036 | A | 10/2017 |

* cited by examiner

GOA CIRCUIT

The present application claims priority to Chinese patent application filed on 2020 Mar. 18 in the National Intellectual Property Administration having application No. 202010190340.0, titled "GOA CIRCUIT", which is incorporated by reference in the present application in its entirety.

FIELD OF INVENTION

The present application relates to the field of display technology, and especially to a gate driver on array (GOA) circuit.

BACKGROUND OF INVENTION

Because organic light-emitting diode (OLED) display panels have self-luminescent properties, OLED display panels must pursue light weight, thin body, and various forms in the future.

Gate driver on array (GOA) technology can achieve a narrower border, a thinner body, higher panel integrity, richer product variety, more simplified manufacturing processes, and more competitive products in the future. Meanwhile, cost of equipment can be decreased, yields of modules can be increased, and cost of chips can be saved. Pixel circuits of large size active-matrix organic light-emitting diode (AMOLED) display panels commonly adopt external compensation technology, and it is often required of gates to output pulse signals of different pulse widths.

However, a conventional GOA circuit cannot simultaneously output pulse signals of different pulse widths. In this regard, researchers and developers in the relevant field consider this as an important research subject.

SUMMARY OF INVENTION

Embodiments of the present application provide a GOA circuit that can effectively resolve that a conventional external compensation circuit of a large size AMOLED display panel cannot simultaneously output suitable pulse signals.

According to one aspect of the present application, embodiments of the present application provide a GOA circuit that includes a plurality of cascaded GOA circuit sharing units, wherein an n-stage GOA circuit sharing unit includes: a pull-up control unit, a first pull-up unit, a second pull-up unit, a feedback unit, a first pull-down maintenance unit, a second pull-down maintenance unit, a third pull-down maintenance unit, a first pull-down unit, a second pull-down unit, an inverting unit, and a bootstrap capacitor; wherein the pull-up control unit, the first pull-up unit, the feedback unit, the first pull-down maintenance unit, the inverting unit, and the first pull-down unit are all electrically connected to a first node; the second pull-up unit is input by a cascade signal and a first direct current power supply; the third pull-down maintenance unit is input by a second direct current power supply; the first pull-down maintenance unit, the inverting unit, the first pull-down unit, and the second pull-down maintenance unit are all electrically connected to a second node; the second pull-down maintenance unit and the third pull-down maintenance unit output a first control signal and a second control signal, respectively; the first pull-down maintenance unit is further input by a third direct current power supply; the pull-up control unit is further input by a first pulse signal; the first pull-up unit is further input by a second pulse signal; except for a first-stage GOA circuit sharing unit, in the n-stage GOA circuit unit: the pull-up control unit is input by a cascade signal of a previous stage; and the first pull-down unit and the second pull-down unit are both input by a cascade signal of a next five stage.

Furthermore, except for the first-stage GOA circuit sharing unit, in the n-stage GOA circuit sharing unit: the pull-up control unit includes an eleventh thin film transistor and a twelfth thin film transistor, wherein a gate of the eleventh thin film transistor and a gate of the twelfth thin film transistor are both input by the first pulse signal, a source of the eleventh thin film transistor is input by the cascade signal of the previous stage, a drain of the eleventh thin film transistor and a source of the twelfth thin film transistor are both electrically connected to a third node, and a drain of the twelfth thin film transistor is electrically connected to the first node; the first pull-down unit includes a thirty-second thin film transistor and a thirty-third thin film transistor, wherein gates of the thirty-second thin film transistor and the thirty-third thin film transistor are both input by the cascade signal of the next five stage, a source of the thirty-second thin film transistor is electrically connected to the first node, a drain of the thirty-second thin film transistor and a source of the thirty-third thin film transistor are both electrically connected to the third node, and a drain of the thirty-third thin film transistor is electrically connected to the third direct current power supply; and the second pull-down unit includes a thirty-first thin film transistor, wherein a gate of the thirty-first thin film transistor is input by the cascade signal of the next five stage, a drain of the thirty-first thin film transistor is electrically connected to the second control signal, and a source of the thirty-first thin film transistor is input by the second direct current power supply.

Furthermore, the feedback unit includes a sixth thin film transistor, a gate of the sixth thin film transistor is electrically connected to the first node, a source of sixth thin film transistor is input by the cascade signal, and a drain of sixth thin film transistor is electrically connected to a third node.

Furthermore, the first pull-up unit includes a twenty-third thin film transistor, a gate of the twenty-third thin film transistor is electrically connected to the first node, a source of the twenty-third thin film transistor is input by the second pulse signal, and a drain of the twenty-third thin film transistor is input by the first control signal.

Furthermore, the second pull-up unit includes a twenty-first thin film transistor and a twenty-second thin film transistor; gates of the twenty-first thin film transistor and the twenty-second thin film transistor are both electrically connected to the first node; sources of the twenty-first thin film transistor and the twenty-second thin film transistor are both input by the first direct current power supply; a drain of the twenty-first thin film transistor is input by the second control signal; and a drain of the twenty-second thin film transistor is input by the cascade signal.

Furthermore, the first pull-down maintenance unit includes a forty-fourth thin film transistor and a forty-fifth thin film transistor; gates of the forty-fourth thin film transistor and the forty-fifth thin film transistor are both electrically connected to the second node; drains of the forty-fourth thin film transistor and the forty-fifth thin film transistor are both electrically connected to a third node; a source of the forty-fourth thin film transistor is electrically connected to the first node; and a source of the forty-fifth thin film transistor is input by the first direct current power supply.

Furthermore, the inverting unit includes a fifty-first thin film transistor, a fifty-second thin film transistor, a fifty-third thin film transistor, and a fifty-fourth thin film transistor; a gate and a source of the fifty-first thin film transistor and a source of the fifty-second thin film transistor are input by the first direct current power supply; a drain of the fifty-first thin film transistor is electrically connected to a gate of the fifty-second thin film transistor and a drain of the fifty-third thin film transistor; a drain of the fifty-second thin film transistor and a drain of the fifty-fourth thin film transistor are both electrically connected to the second node; sources of the fifty-third thin film transistor and the fifty-fourth thin film transistor are input by the second direct current power supply; and gates of the fifty-third thin film transistor and the fifty-fourth thin film transistor are electrically connected to the first node.

Furthermore, the second pull-down maintenance unit includes a forty-second thin film transistor and a forty-third thin film transistor; gates of the forty-second thin film transistor and the forty-third thin film transistor are both electrically connected to the second node; sources of the forty-second thin film transistor and the forty-third thin film transistor are both input by the second direct current power supply; a drain of the forty-second thin film transistor is input by the cascade signal; and a drain of the forty-third thin film transistor is input by the first control signal.

Furthermore, the third pull-down maintenance unit includes a forty-first thin film transistor, a gate of the forty-first thin film transistor is electrically connected to the second node, a source of the forty-first thin film transistor is input by the second direct current power supply, and a drain of the forty-first thin film transistor is input by the second control signal.

Furthermore, the first direct current power supply is at a high electrical level, the third direct current power supply and the second direct current power supply are at a low electrical level, and the first pulse signal and the second pulse signal are high frequency alternating current signals with opposite waveforms.

Advantages of the present application are that in the present application, through a pull-up control unit pulling up an electric potential of a first node, a cascade signal, a first control signal, and a second control signal, and through a bootstrap capacitor secondarily pulling up an electric potential of the first node, such a design facilitates output of the cascade signal, the first control signal, and the second control signal. The present application can simultaneously output a wide pulse width signal and a narrow pulse width signal, such that thin film transistors in a GOA circuit can be operated in a saturation area, which is adaptable to an application of external compensation of large size AMOLED display panels.

DESCRIPTION OF DRAWINGS

With reference to the following drawings, the technical approach and other beneficial effects of the present application will be obvious through describing embodiments of the present application in detail.

DETAILED DESCRIPTION OF PREFERRED EMBODIMENTS

Figure 1:
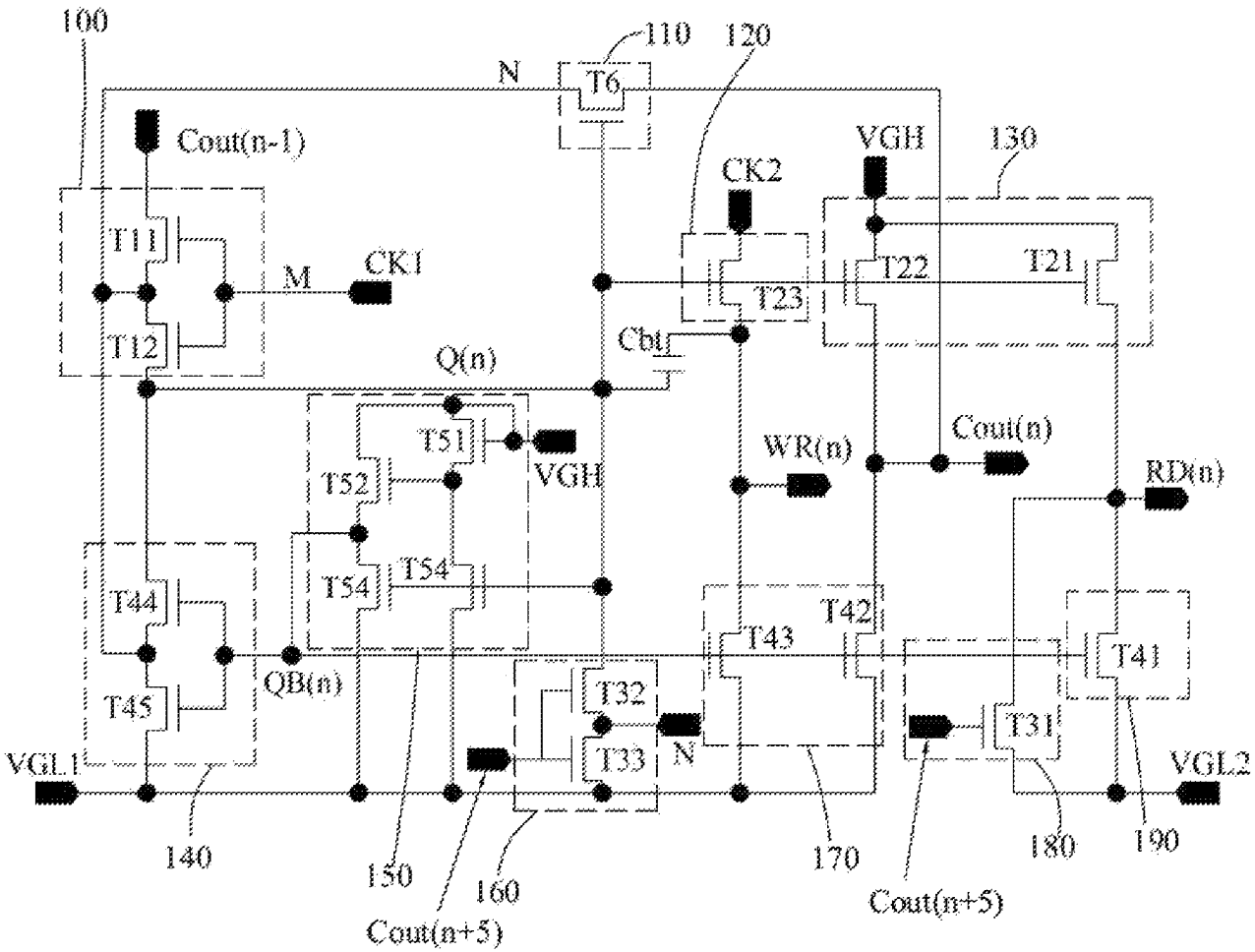
FIG. 1 is a circuit diagram of a gate driver on array (GOA) circuit according to an embodiment of the present application.

The embodiments of the present application are described in detail hereinafter. Examples of the described embodiments are given in the accompanying drawings. It should be noted that the following embodiments are intended to illustrate and interpret the present application, and shall not be construed as causing limitations to the present application. Similarly, the following embodiments are part of the embodiments of the present application and are not the whole embodiments, and all other embodiments obtained by those skilled in the art without making any inventive efforts are within the scope protected by the present application.

In description of the present application, it should be understood that terms that indicates orientation or relation of position such as "center", "longitudinal", "lateral", "length", "width", "thickness", "upper", "lower", "front", "rear", "left", "right", "vertical", "horizontal", "top", "bottom", "interior", "exterior", "clockwise", "counterclockwise" are based on orientation or relation of position accompanying drawings show. They are simply for purpose of description of the present application and simplifying of description, and do not mean or suggest the devices or components have a specified orientation and constructed and operated in a specified orientation; therefore, it should not be understood as limitation of the present application. Furthermore, terms "first" and "second" are used simply for purpose of description and cannot be understood to mean or suggest relative importance or implicitly mean amount of the technical features. Therefore, features with terms "first" and "second" can mean or implicitly include one or more of the features. In description of the present application, "multiple" means two or more unless otherwise clearly and concretely specified.

In description of the present application, unless otherwise clearly defined or specified, it should be explained that terms such as "mount", "connect", "secure", etc. should be understood in a wide sense. For example, it can be fixedly connected, detachably connected, or one-piece; it can be mechanically connected, electrically connected, or mutually communicable; it can be directly connected or indirectly connected through an intermediate media; and it can be an internal connection of two devices or effect relation of two devices to each other. For a person of ordinary skill in the art, specific meaning of the above-mentioned terms in the present application can be understood according to specific conditions.

In the present application, unless otherwise clearly specified and limited, that a first feature is "on" or "below" a second feature can include that the first feature directly contacts the second feature, and also can include that the first feature contacts the second feature through other features between them rather than their direct contact. Furthermore, that a first feature is "on top of", "above", and "on an upper side of" a second feature includes that the first feature is on right top of and obliquely above the second feature, or merely means that a horizontal height of the first feature is greater than that of the second feature. That a first feature is "at a bottom of", "below", and "on an lower side of" a second feature includes that the first feature is at the right bottom of and obliquely below the second feature, or merely means that a horizontal height of the first feature is less than that of the second feature.

Contents disclosed below provide many different embodiments or examples to realize different structures according to the present application. For the purpose of simplifying description of the present application, contents below describe parts and configuration of specific examples. Naturally, they are merely for illustration and do not intend to limit the present application. Furthermore, reference numerals and/or letters can be repeated in different examples of the present application, and this repeat is for the purse of simplification and clearness, not indicating relations between various embodiments and/or configurations under discussion. Furthermore, the present application provides examples of various specific processes and materials; however, a person of ordinary skill in the art can think of applications of other processes and/or materials.

As shown in FIG. 1, FIG. 1 is a circuit diagram of a gate driver on array (GOA) circuit according to an embodiment of the present application. The GOA circuit includes a plurality of cascaded GOA circuit sharing units, wherein an n-stage GOA circuit sharing unit includes: a pull-up control unit 100, a first pull-up unit 120, a second pull-up unit 130, a feedback unit 110, a first pull-down maintenance unit 140, a second pull-down maintenance unit 170, a third pull-down maintenance unit 190, a first pull-down unit 160, a second pull-down unit 180, an inverting unit 150, and a bootstrap capacitor Cbt.

Wherein, the pull-up control unit 100 is configured to pull up electric potential of a first node Q(n), a cascade signal Cout(n), a first control signal WR(n), and a second control signal RD(n). The feedback unit 110 is configured to pull up electrical potential of a third node N and decrease drain current of a twelfth thin film transistor T12, a forty-fourth thin film transistor T44, and a thirty-second thin film transistor T32. The first pull-down unit 160 and the second pull-down unit 180 are configured to pull down an electric potential of the first node Q(n) and an electric potential of an output signal to a low electric potential. The first pull-down maintenance unit 140, the second pull-down maintenance unit 170, and the third pull-down maintenance unit 190 are configured to maintain electric potential of the first node Q(n) and the third node N at a low electrical level state. The inverting unit 150 is mainly configured to invert the electric potential of the first node Q(n) and the second node QB(n). The bootstrap capacitor Cbt is configured to secondarily pull up the electric potential of the first node Q(n), thereby facilitating output of the first control signal WR(n) and the second control signal RD(n).

In the present embodiment, the pull-up control unit 100, the first pull-up unit 120, the feedback unit 110, the first pull-down maintenance unit 140, the inverting unit, and the first pull-down unit 160 are all electrically connected to the first node Q(n).

The second pull-up unit 130 is input by the cascade signal Cout(n) and a first direct current power supply VGH. The third pull-down maintenance unit 190 is input by a second direct current power supply VGL2. The first pull-down maintenance unit 140, the inverting unit 150, the first pull-down unit 160, and the second pull-down maintenance unit 170 are all electrically connected to the second node QB(n).

The second pull-down maintenance unit 170 and the third pull-down maintenance unit 190 outputs the first control signal WR(n) and the second control signal, respectively.

The first pull-down maintenance unit 140 is further input by a third direct current power supply VGL1. The pull-up control unit 100 is further input by a first pulse signal CK1. The first pull-up unit 120 is further input by a second pulse signal CK2.

In all n-stage GOA circuit sharing units excluding the first-stage GOA circuit sharing unit:

The pull-up control unit 100 is input by a cascade signal of a previous stage Cout(n−1). The first pull-down unit 160 and the second pull-down unit 180 are both input by a cascade signal of a next five stage Cout(n+5).

Furthermore, in all n-stage GOA circuit sharing units excluding the first-stage GOA circuit sharing unit, the pull-up control unit 100 includes an eleventh thin film transistor T11 and a twelfth thin film transistor T12, wherein a gate of the eleventh thin film transistor T11 and a gate of the twelfth thin film transistor T12 are both input by the first pulse signal CK1, a source of the eleventh thin film transistor T11 is input by the cascade signal of the previous stage Cout(n−1), a drain of the eleventh thin film transistor T11 and a source of the twelfth thin film transistor T12 are both electrically connected to the third node N, and a drain of the twelfth thin film transistor T12 is electrically connected to the first node Q(n). The first pull-down unit 160 includes a thirty-second thin film transistor T32 and a thirty-third thin film transistor T33. Gates of the thirty-second thin film transistor T32 and the thirty-third thin film transistor T33 are both input by the cascade signal of the next five stage Cout(n+5). A source of the thirty-second thin film transistor T32 is electrically connected to the first node Q(n), and a drain of the thirty-second thin film transistor T32 and a source of the thirty-third thin film transistor T33 are both electrically connected to the third node N. A drain of the thirty-third thin film transistor T33 is electrically connected to the third direct current power supply VGL1. The second pull-down unit 180 includes a thirty-first thin film transistor T31, wherein a gate of the thirty-first thin film transistor T31 is input by the cascade signal of the next five stage Cout (n+5), a drain of the thirty-first thin film transistor T31 is electrically connected to the second control signal RD(n), and a source of the thirty-first thin film transistor T31 is input by the second direct current power supply VGL2.

Furthermore, the feedback unit 110 includes a sixth thin film transistor T6, wherein a gate of the sixth thin film transistor T6 is electrically connected to the first node Q(n), a source of sixth thin film transistor T6 is input by the cascade signal Cout(n), and a drain of sixth thin film transistor T6 is electrically connected to the third node N.

Furthermore, the first pull-up unit 120 includes a twenty-third thin film transistor T23, wherein a gate of the twenty-third thin film transistor T23 is electrically connected to the first node Q(n), a source of the twenty-third thin film transistor T23 is input by the second pulse signal CK2, and a drain of the twenty-third thin film transistor T23 is input by the first control signal WR(n).

Furthermore, the second pull-up unit 130 includes a twenty-first thin film transistor T21 and a twenty-second thin film transistor T22. Gates of the twenty-first thin film transistor T21 and the twenty-second thin film transistor T22 are both electrically connected to the first node Q(n). Sources of the twenty-first thin film transistor T21 and the twenty-second thin film transistor T22 are both input by the first direct current power supply VGH. A drain of the twenty-first thin film transistor T21 is input by the second control signal RD(n). A drain of the twenty-second thin film transistor T22 is input by the cascade signal Cout(n).

Furthermore, the first pull-down maintenance unit 140 includes a forty-fourth thin film transistor T44 and a forty-fifth thin film transistor T45. Gates of the forty-fourth thin film transistor T44 and the forty-fifth thin film transistor T45 are both electrically connected to the second node QB(n). Drains of the forty-fourth thin film transistor T44 and the forty-fifth thin film transistor T45 are both electrically connected to the third node N, and a source of the forty-fourth thin film transistor T44 is electrically connected to the first node Q(n). A source of the forty-fifth thin film transistor T45 is input by the first direct current power supply VGH.

Furthermore, the inverting unit 150 includes a fifty-first thin film transistor T51, a fifty-second thin film transistor T52, a fifty-third thin film transistor T53, and a fifty-fourth thin film transistor T54. A gate and a source of the fifty-first thin film transistor T51 and a source of the fifty-second thin film transistor T52 are input by the first direct current power supply VGH. A drain of the fifty-first thin film transistor T51 is electrically connected to a gate of the fifty-second thin film transistor T52 and a drain of the fifty-third thin film transistor T53. A drain of the fifty-second thin film transistor T52 and a drain of the fifty-fourth thin film transistor T54 are both electrically connected to the second node QB(n). Sources of the fifty-third thin film transistor T53 and the fifty-fourth thin film transistor T54 are input by the second direct current power supply VGL2. Gates of the fifty-third thin film transistor T53 and the fifty-fourth thin film transistor T54 are electrically connected to the first node Q(n).

Furthermore, the second pull-down maintenance unit 170 includes a forty-second thin film transistor T42 and a forty-third thin film transistor T43. Gates of the forty-second thin film transistor T42 and the forty-third thin film transistor T43 are both electrically connected to the second node QB(n). Sources of the forty-second thin film transistor T42 and the forty-third thin film transistor T43 are both input by the second direct current power supply VGL2. A drain of the forty-second thin film transistor T42 is input by the cascade signal Cout(n), and a drain of the forty-third thin film transistor T43 is input by the first control signal WR(n).

Furthermore, the third pull-down maintenance unit 190 includes a forty-first thin film transistor T41, wherein a gate of the forty-first thin film transistor T41 is electrically connected to the second node QB(n), a source of the forty-first thin film transistor T41 is input by the second direct current power supply VGL2, and a drain of the forty-first thin film transistor T41 is input by the second control signal RD(n).

Furthermore, the first direct current power supply VGH is at a high electrical level. The third direct current power supply VGL1 and the second direct current power supply VGL2 are at a low electrical level. The first pulse signal CK1 and the second pulse signal CK2 are high frequency alternating current signals with opposite waveforms.

Figure 2:
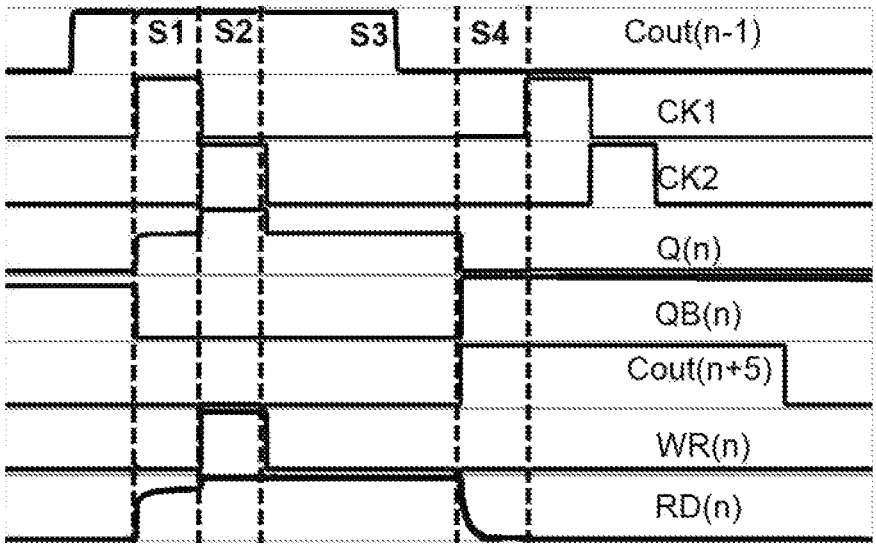
FIG. 2 is a timing diagram of alternating current signals according to an embodiment of the present application.
Figure 3:
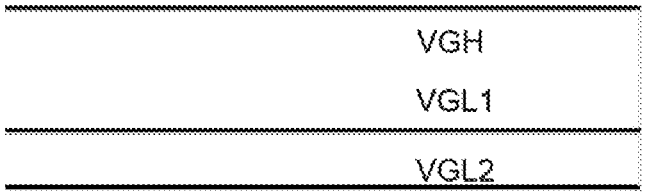
FIG. 3 is a timing diagram of direct current signals according to an embodiment of the present application.

As shown in FIG. 2 and FIG. 3, during a course of a practical operation of the GOA circuit, it is mainly divided into four stages:

Stage S1: the first pulse signal CK1 is at a high electric potential, and the eleventh thin film transistor T11 and the twelfth thin film transistor T12 are turned on. Because the cascade signal of the previous stage Cout(n−1) is at a high electric potential, the first node Q(n) is pulled up to a high electric potential, and the twenty-first thin film transistor T21, the twenty-second thin film transistor T22, the twenty-third thin film transistor T23, the fifty-third thin film transistor T53, and the fifty-fourth thin film transistor T54 are turned on. The second node QB(n) is at a low electric potential, and the forty-first thin film transistor T41, the forty-second thin film transistor T42, the forty-third thin film transistor T43, the forty-fifth thin film transistor T45, and the forty-fourth thin film transistor T44 are turned off. The first control signal WR(n) outputs a low electric potential, and the cascade signal Cout(n) and the second control signal RD(n) output a high electric potential. The sixth thin film transistor T6 is turned on, and the third node N is pulled up to a high electric potential.

Stage S2: the first pulse signal CK1 is at a low electric potential, and the eleventh thin film transistor T11 and the twelfth thin film transistor T12 are turned off. Because the second pulse signal CK2 is at a high electric potential, the first control signal WR(n) outputs a high electric potential, the first node Q(n) is coupled to a higher electric potential, and the cascade signal Cout(n) and the second control signal RD(n) output a high electric potential. The third node N is maintained at a high electric potential.

Stage S3: the first pulse signal CK1 is at a low electric potential, and the eleventh thin film transistor T11 and the twelfth thin film transistor T12 are turned off. The second pulse signal CK2 becomes a low electric potential, the first control signal WR(n) outputs a low electric potential, and the cascade signal Cout(n) and the second control signal RD(n) is maintained at a high electric potential.

Stage S4: the first pulse signal CK1 is at a low electric potential, and the eleventh thin film transistor T11 and the twelfth thin film transistor T12 are turned off. The cascade signal of the next five stage Cout(n+5) becomes a high electric potential, and the thirty-first thin film transistor T31, the thirty-third thin film transistor T33, and the thirty-second thin film transistor T32 are turned on. The first node Q(n) and the second control signal RD(n) are pulled down to a low electric potential, the twenty-first thin film transistor T21, the twenty-second thin film transistor T22, and the twenty-third thin film transistor T23 are turned off, and the first control signal WR(n) is maintained at a low electric potential.

Therefore, the first control signal WR(n) is a narrow pulse width signal output, with a high electrical level being maintained during the stage S2. The second control signal RD(n) is a wide pulse width signal output, with a high electrical level being maintained during the stages S1-S3. In this way, a simultaneous output of a wide pulse width signal and a narrow pulse width signal can be realized, such that switch transistors in a driving circuit can be operated in a saturation area, which is adaptable to an application of external compensation of large size active-matrix organic light-emitting diode (AMOLED) display panels.

Advantages of the present application are that in the present application, through a pull-up control unit pulling up an electric potential of a first node, a cascade signal, a first control signal, and a second control signal, and through a bootstrap capacitor secondarily pulling up an electric potential of the first node, such a design facilitates output of the cascade signal, the first control signal, and the second control signal. The present application can simultaneously output a wide pulse width signal and a narrow pulse width signal, such that switch transistors in a driving circuit can be operated in a saturation area, which is adaptable to an application of external compensation of large size AMOLED display panels.

In the above-mentioned embodiments, description for each embodiment has different emphases, and contents not described in detail in one embodiment can be referred to relevant description of other embodiments.

It should be understood that illustrative embodiments described above are descriptive, intended to facilitate understanding of the approach and main idea of the present application, and not intended to limit the present application. Description of features or aspects in each illustrative embodiment should generally be considered to apply to similar features or aspects of other illustrative embodiments. Although illustrative embodiments describe the present application, they can suggest to those skilled in the art making variations and modifications. The present application intends to include the variations and modifications within the scope of the appended claims, and many changes and modifications to the described embodiments can be carried out without departing from the scope and the spirit of the present application that is intended to be limited only by the appended claims.

What is claimed is:

1. A gate driver on array (GOA) circuit, comprising a plurality of cascaded GOA circuit sharing units, wherein an n-stage GOA circuit sharing unit comprises: a pull-up control unit, a first pull-up unit, a second pull-up unit, a feedback unit, a first pull-down maintenance unit, a second pull-down maintenance unit, a third pull-down maintenance unit, a first pull-down unit, a second pull-down unit, an inverting unit, and a bootstrap capacitor;

wherein the pull-up control unit, the first pull-up unit, the feedback unit, the first pull-down maintenance unit, the inverting unit, and the first pull-down unit are all electrically connected to a first node;

the second pull-up unit is input by a cascade signal and a first direct current power supply;

the third pull-down maintenance unit is input by a second direct current power supply;

the first pull-down maintenance unit, the inverting unit, the first pull-down unit, and the second pull-down maintenance unit are all electrically connected to a second node;

the second pull-down maintenance unit and the third pull-down maintenance unit output a first control signal and a second control signal, respectively;

the first pull-down maintenance unit is further input by a third direct current power supply;

the pull-up control unit is further input by a first pulse signal; and the first pull-up unit is further input by a second pulse signal;

wherein in all n-stage GOA sharing circuit units except for a first-stage GOA circuit sharing unit:

the pull-up control unit is input by a cascade signal of a previous stage; and the first pull-down unit and the second pull-down unit both input by a cascade signal of a next five stage.

2. The GOA circuit as claimed in claim 1, wherein the n-stage GOA circuit sharing unit, excepting the first-stage GOA circuit sharing unit:

the pull-up control unit comprises an eleventh thin film transistor and a twelfth thin film transistor, wherein a gate of the eleventh thin film transistor and a gate of the twelfth thin film transistor are both input by the first pulse signal, a source of the eleventh thin film transistor is input by the cascade signal of the previous stage, a drain of the eleventh thin film transistor and a source of the twelfth thin film transistor are both electrically connected to a third node, and a drain of the twelfth thin film transistor is electrically connected to the first node;

the first pull-down unit comprises a thirty-second thin film transistor and a thirty-third thin film transistor, wherein gates of the thirty-second thin film transistor and the thirty-third thin film transistor are both input by the cascade signal of the next five stage, a source of the thirty-second thin film transistor is electrically connected to the first node, a drain of the thirty-second thin film transistor and a source of the thirty-third thin film transistor are both electrically connected to the third node, and a drain of the thirty-third thin film transistor is electrically connected to the third direct current power supply; and the second pull-down unit comprises a thirty-first thin film transistor, wherein a gate of the thirty-first thin film transistor is input by the cascade signal of the next five stage, a drain of the thirty-first thin film transistor is electrically connected to the second control signal, and a source of the thirty-first thin film transistor is input by the second direct current power supply.

3. The GOA circuit as claimed in claim 1, wherein the feedback unit comprises a sixth thin film transistor, a gate of the sixth thin film transistor is electrically connected to the first node, a source of sixth thin film transistor is input by the cascade signal, and a drain of sixth thin film transistor is electrically connected to a third node.

4. The GOA circuit as claimed in claim 1, wherein the first pull-up unit comprises a twenty-third thin film transistor, a gate of the twenty-third thin film transistor is electrically connected to the first node, a source of the twenty-third thin film transistor is input by the second pulse signal, and a drain of the twenty-third thin film transistor is input by the first control signal.

5. The GOA circuit as claimed in claim 1, wherein the second pull-up unit comprises a twenty-first thin film transistor and a twenty-second thin film transistor;

gates of the twenty-first thin film transistor and the twenty-second thin film transistor are both electrically connected to the first node;

sources of the twenty-first thin film transistor and the twenty-second thin film transistor are both input by the first direct current power supply;

a drain of the twenty-first thin film transistor is input by the second control signal; and a drain of the twenty-second thin film transistor is input by the cascade signal.

6. The GOA circuit as claimed in claim 1, wherein the first pull-down maintenance unit comprises a forty-fourth thin film transistor and a forty-fifth thin film transistor;

gates of the forty-fourth thin film transistor and the forty-fifth thin film transistor are both electrically connected to the second node;

drains of the forty-fourth thin film transistor and the forty-fifth thin film transistor are both electrically connected to a third node;

a source of the forty-fourth thin film transistor is electrically connected to the first node; and a source of the forty-fifth thin film transistor is input by the first direct current power supply.

7. The GOA circuit as claimed in claim 1, wherein the inverting unit comprises a fifty-first thin film transistor, a fifty-second thin film transistor, a fifty-third thin film transistor, and a fifty-fourth thin film transistor;

a gate and a source of the fifty-first thin film transistor and a source of the fifty-second thin film transistor are input by the first direct current power supply;

a drain of the fifty-first thin film transistor is electrically connected to a gate of the fifty-second thin film transistor and a drain of the fifty-third thin film transistor;

a drain of the fifty-second thin film transistor and a drain of the fifty-fourth thin film transistor are both electrically connected to the second node;

sources of the fifty-third thin film transistor and the fifty-fourth thin film transistor are input by the second direct current power supply; and gates of the fifty-third thin film transistor and the fifty-fourth thin film transistor are electrically connected to the first node.

8. The GOA circuit as claimed in claim 1, wherein the second pull-down maintenance unit comprises a forty-second thin film transistor and a forty-third thin film transistor;

gates of the forty-second thin film transistor and the forty-third thin film transistor are both electrically connected to the second node;

sources of the forty-second thin film transistor and the forty-third thin film transistor are both input by the second direct current power supply;

a drain of the forty-second thin film transistor is input by the cascade signal; and a drain of the forty-third thin film transistor is input by the first control signal.

9. The GOA circuit as claimed in claim 1, wherein the third pull-down maintenance unit comprises a forty-first thin film transistor, a gate of the forty-first thin film transistor is electrically connected to the second node, a source of the forty-first thin film transistor is input by the second direct current power supply, and a drain of the forty-first thin film transistor is input by the second control signal.

10. The GOA circuit as claimed in claim 1, wherein the first direct current power supply is at a high electrical level, the third direct current power supply and the second direct current power supply are at a low electrical level, and the first pulse signal and the second pulse signal are high frequency alternating current signals with opposite waveforms.

* * * * *